United States Patent [19]

Shimodaira

[11] Patent Number: 4,609,295

[45] Date of Patent: Sep. 2, 1986

[54] HAND-HELD PRINTING CALCULATOR

[75] Inventor: Tadayoshi Shimodaira, Shiojiri, Japan

[73] Assignee: Seiko Epson Corporation, Tokyo, Japan

[21] Appl. No.: 457,296

[22] Filed: Jan. 11, 1983

Related U.S. Application Data

[63] Continuation of Ser. No. 136,229, Apr. 1, 1980, abandoned.

[30] Foreign Application Priority Data

Apr. 10, 1979 [JP] Japan ..... 54-43318
Apr. 10, 1979 [JP] Japan ..... 54-47120

[51] Int. Cl.[4] ..... B41J 3/36

[52] U.S. Cl. ..... 400/88; 400/152; 400/624; 400/629; 400/635; 400/641; 400/708; 101/110

[58] Field of Search ..... 400/88, 91, 92, 93, 400/94, 618, 624, 629, 635, 641, 708, 708.1; 101/110; 235/2, 3, 4, 5, 31 R, 31 T, 58 P, 59 TP, 60 P; 346/17, 76 R, 76 PH; 340/365 R; 271/3.1, 4, 9

[56] References Cited

U.S. PATENT DOCUMENTS

| | | | |
|---|---|---|---|
| 994,905 | 6/1911 | Burch | 400/629 |
| 1,182,052 | 5/1916 | Stocking et al. | 400/629 X |
| 3,124,230 | 3/1964 | Bustamante | 400/88 X |
| 3,430,748 | 3/1969 | Parri | 400/629 X |
| 4,040,511 | 8/1977 | Beaven, Jr. et al. | 400/120 X |
| 4,095,686 | 6/1978 | Okabe | 101/110 X |
| 4,143,382 | 3/1979 | Brill et al. | 346/17 X |
| 4,212,456 | 7/1980 | Ruenzi | 400/629 X |
| 4,258,624 | 3/1981 | Mitsui | 101/110 X |

FOREIGN PATENT DOCUMENTS

| | | | |
|---|---|---|---|
| 1088297 | 9/1954 | France | 400/708 |
| 1090636 | 10/1954 | France | 400/708 |
| 2037665 | 7/1980 | United Kingdom | 400/88 |
| 2046671 | 11/1980 | United Kingdom | 400/88 |

OTHER PUBLICATIONS

IBM Technical Disclosure Bulletin, "Wheel Printer", Bowdle, vol. 8, No. 10, Mar. 1966, p. 1432.

IBM Technical Disclosure Bulletin, "Sheet-Feed Sensing", Korte et al, vol. 20, No. 1, Jun. 1977, pp. 25–26.

*Primary Examiner*—Ernest T. Wright, Jr.

*Attorney, Agent, or Firm*—Blum Kaplan Friedman Silberman & Beran

[57] ABSTRACT

A hand-held printing calculator for printing calculating results on elongated paper strips from a bundle of paper strips disposed within the calculator is provided. The calculator includes a microprinter having a paper feeding assembly including feeding elements disposed before and after the print position and in the same plane as the advancing paper for maintaining the paper flat during printing. In another embodiment of the invention, a detection sensor detects the absence of a paper strip at the print position for generating a signal for feeding the next paper strip so that paper is continuously fed to the print position.

5 Claims, 8 Drawing Figures

FIG. 1
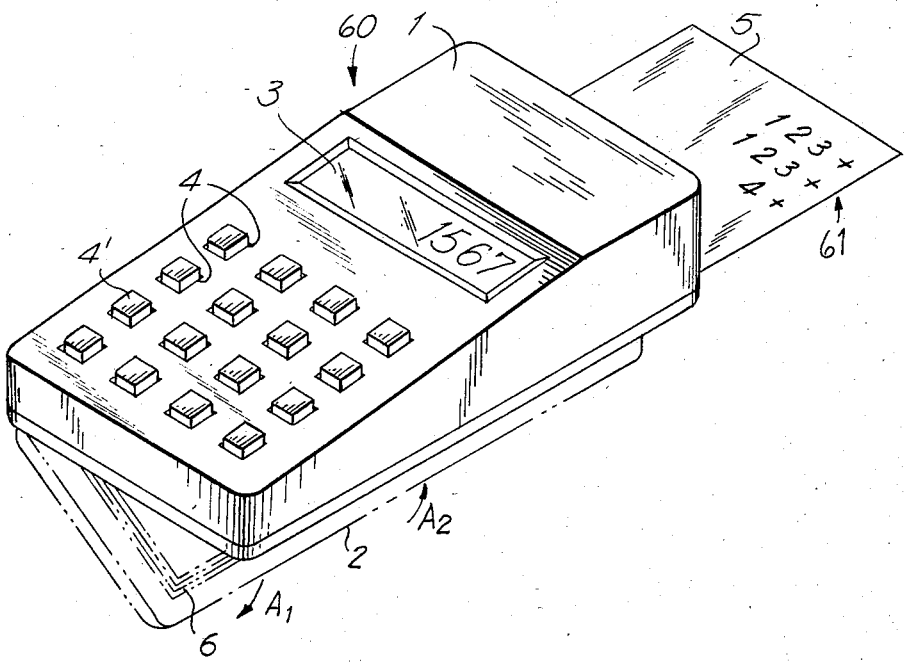
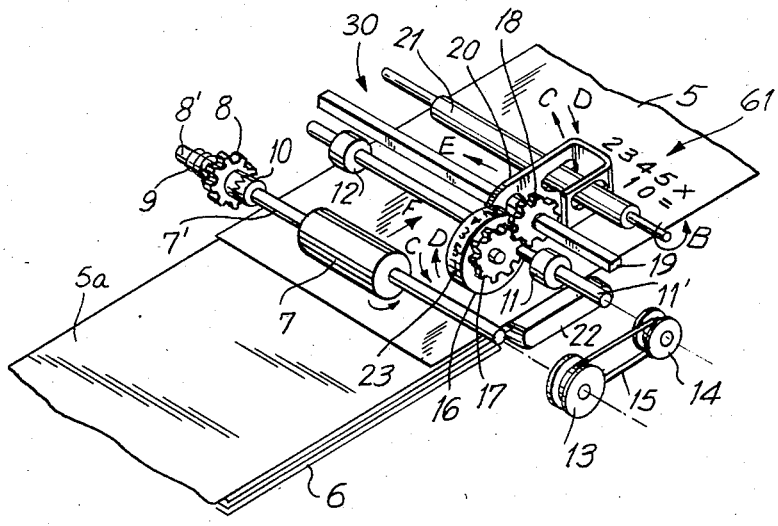
FIG. 2

FIG. 3
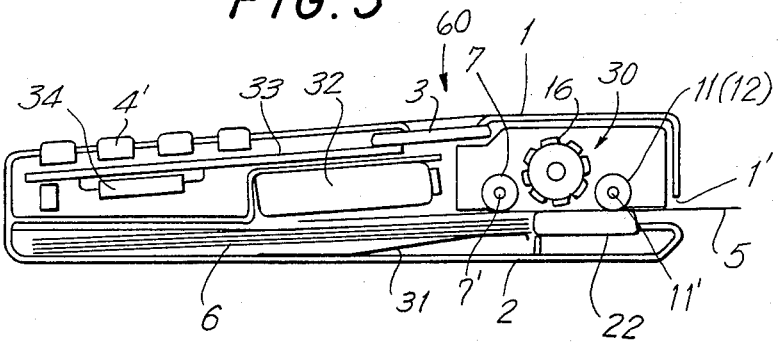
FIG. 4
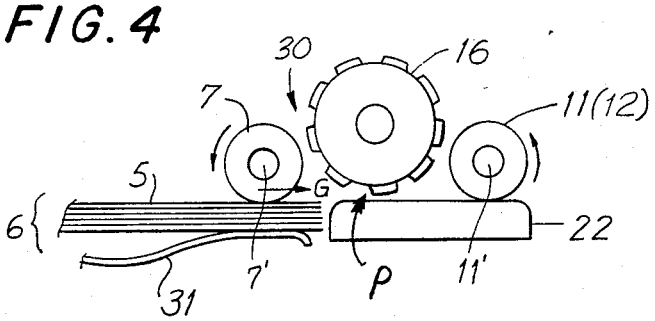
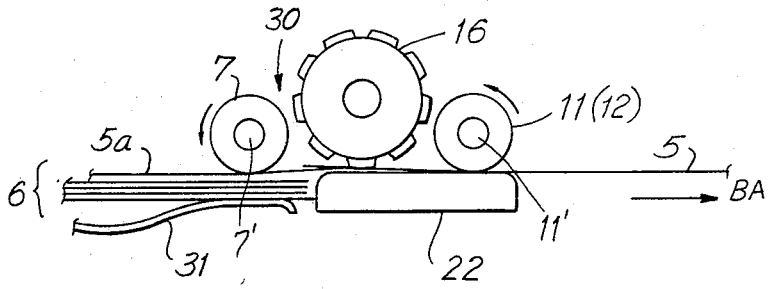
FIG. 5

HAND-HELD PRINTING CALCULATOR

CROSS-REFERENCE TO RELATED APPLICATION

This application is a continuation of application Ser. No. 136,229, filed on Apr. 1, 1980, now abandoned.

BACKGROUND OF THE INVENTION

This invention relates generally to a hand-held printing calculator and more particularly to a hand-held calculator for printing calculating results on elongated paper strips stored within the calculator.

Recently, electronic calculators have become substantially miniaturized as a result of technical improvements and capabilities in assembly. This reduction in size is due principally to the high integration and low power consumption of the large scale integrated circuits (LSI), the reduced thickness and low power consumption of improved liquid crystal displays, the reduced thickness of batteries and simplification of the keyboard and the like. However, electronic calculators including printing capabilities have not been substantially miniaturized even though the printer itself has been miniaturized. This is due to the fact that a roll of print paper continues to be used as the printing medium. The paper roll because of its bulk is not particularly well suited for use in hand-held electronic calculators.

Accordingly, it would be desirable to eliminate this disadvantage of having to use a roll of print paper as the printing medium in a hand-held calculator.

SUMMARY OF THE INVENTION

Generally speaking, in accordance with the invention, a hand-held printing calculator for printing calculating results on elongated paper strips from a bundle of paper strips disposed within the calculator body is provided. The bundle of paper strips permits continuous printing so long as the paper strips are continuously fed to the calculator print position. This bundle of paper strips avoids the need to use cumbersome rolls of print paper.

The calculator includes a microprinter having a paper feeding assembly including frictional paper feeding elements disposed both before and after the print position. Generally, the frictional paper feeding elements are paper feeding rollers disposed before and after a character ring, a plurality of character rings, or a mechanical or thermal dot printer head. The frictional paper feeding element disposed after the print position feeds at a greater rate than the frictional paper feeding element before the print position to insure that the paper strip is held flat during printing. Both feeding elements lie substantially in the same plane as the paper being advanced at the print position. In addition, a detection sensor disposed at the print position determines the presence of a paper strip at the print position. A signal is generated by the detection sensor in the absence of a paper strip for continuously supplying paper strips to the print position.

Accordingly, it is an object of this invention to provide an improved hand-held printing calculator.

Another object of the invention is to provide an improved hand-held calculator including a microprinter assembly.

A further object of the invention is to provide an improved microprinter for printing calculating results on paper strips disposed in a bundle stored in the calculator.

Still another object of the invention is to provide an improved paper feeding assembly for a microprinter printing on paper strips.

Still a further object of the invention is to provide an improved microprinter having paper feeding elements disposed before and after the print position.

Yet another object of the invention is to provide an improved microprinter paper feeding assembly with feeding elements disposed before and after the print position, each feeding element feeding different amounts of paper.

Another object of the invention is to provide an improved microprinter for printing on paper strips fed by frictional elements.

A further object of the invention is to provide an improved microprinter having a sensor for detecting the absence of a print paper at a print position for generating signals for feeding the print paper.

Still other objects and advantages of the invention will in part by obvious and will in part be apparent from the specification.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWING

For a fuller understanding of the invention, reference is had to the following description taken in connection with the accompanying drawing, in which:

FIG. 1 is a perspective view of a hand-held electronic calculator including a microprinter constructed and arranged in accordance with the invention;

FIG. 2 is a perspective view of the microprinter utilized in the calculator shown in FIG. 1;

FIG. 3 is a sectional-side view of the hand-held electronic calculator depicted in FIG. 1;

FIG. 4 is a elevational view of the microprinter of FIG. 2;

FIG. 5 is an elevational view of the microprinter of FIG. 2 in a different print paper strip advancing state;

DESCRIPTION OF THE PREFERRED EMBODIMENTS

Figure 6:
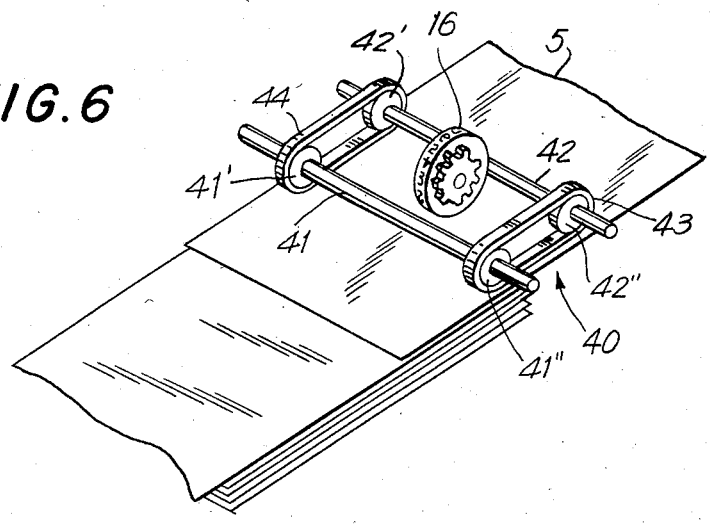
FIG. 6 is a perspective view of a paper feeding assembly of the microprinter of FIG. 2 constructed and arranged in accordance with another embodiment of the invention.

Referring now to FIG. 1, a hand-held printing calculator 60 constructed and arranged in accordance with the invention is shown. Calculator 60 includes a calculator case 1 having a back cover 2 which may be opened in the direction indicated by arrow $A_1$ and closed in the direction of arrow $A_2$. Calculator case 1 and back cover 2 form an interior space for placement of a microprinter 30 as illustrated in FIGS. 2 and 3. In addition to microprinter 30, calculator 60 includes a display 3 for showing calculating results which may be a display, such as a liquid crystal display, an LED display, or the like.

Calculator case 1 is formed with a plurality of openings 4 for placement of a keyboard including a pluarality of input keys 4'.

Calculator 60 prints a calculating result 61 on a paper strip 5 which is stored flat as a bundle 6 within the interior space of calculator case 1. Paper strip 5 is removed from calculator case 1 after printing by microprinter 30 in accordance with the invention as will be described in more detail below. Bundle 6 is placed within the interior space of calculator case 1 by opening back cover 2 in direction $A_1$. As can be seen by the overall shape of calculator 60, using paper strip bundle 6 provides a handsomely streamlined printing electronic calculator.

Turning now to FIG. 2, microprinter 30 constructed and arranged in accordance with the invention which is utilized in electronic calculator 60 of FIG. 1 is shown. Paper strip bundle 6 which is disposed inside back cover 2 of calculator 60 is shown with calculating result 61 printed on paper strip 5. Microprinter 30 includes a first paper feeding roller 7 mounted on a shaft 7' which is disposed between the side frames (not shown) of the microprinter 30. A drive gear 8 for selectively rotating paper feeding roller 7 is mounted on a drive shaft 8' to the outside of a coupling 10 and is biased towards shaft 7' by a spring 9 to place roller 7 in an operative position.

A pair of second stage paper feeding rollers 11 and 12 are each fixed to a second paper feeding shaft 11' positioned behind a character ring 16 after a print position P and includes a second feed pulley 14 mounted thereon. A first paper feed pulley 13 is mounted on first paper feed shaft 7' for cooperating with second feed pulley 14. Second paper feeding shaft 11' is operatively engaged with first paper feeding shaft 7' by a belt 15 disposed about first pulley 13 and second pulley 14. Second feed pulley 14 and second stage paper feeding rollers 11 and 12 have smaller diameters than first feed pulley 13 and roller 7 so that rollers 11 and 12 rotate at a faster rate than roller 7. This insures that paper strip 5 remains in a flat condition during printing.

In microprinter 30 illustrated in FIG. 2, printing is performed by character ring 16 having a plurality of characters 23 disposed about the periphery. A ring gear 17 is fixed to the side of print character ring 16. A print gear 18 is operatively engaged with ring gear 17 and is mounted on a square shaft 19 for rotating character ring 16. Character ring 16 and print gear 18 are disposed within a U-shaped frame 20 slideably mounted on an eccentric shaft 21 which is rotatable in a counterclockwise direction as indicated by arrow B. Rotation of eccentric shaft 21 in the direction of arrow B causes print character ring 16 to be displaced in a print direction indicated by arrow C for printing on paper strip 5 against a platen 22. The printing operation will now be described in more detail as follows.

Square shaft 19 rotates character ring 16 in response to print control signals from a print control circuit (not shown). A detector (not illustrated) detects the position of a character 23 on the periphery of character ring 16 and when the position signal coincides with a calculating result, printing occurs by pivoting of frame 20 towards print position P and frame 20 returns to its at rest position by pivoting in direction of arrow D. Character ring 16 is displaced towards paper strip 5 and platen 22 when eccentric shaft 21 is rotated in arrow direction B. This pivoting of frame 20 occurs each time print character 23 is printed by operating a one-turn clutch (not illustrated) which is provided on eccentric shaft 21. This description of the printing is for printing a single column. Additional columns of the calculating results are printed in the same manner by sliding frame 20 step wise in the direction of arrow E. After printing of one line is completed paper strip 5 is advanced by roller 7, and rollers 11 and 12 for advancing paper strip 5 in the direction of arrow F.

In microprinter 30 constructed and arranged in accordance with the invention as illustrated in FIG. 2, first paper feeding roller 7 is disposed before character ring 16 and second feeding rollers 11 and 12 are disposed behind character ring 16. This particular arrangement permits continuous feeding of paper strip 5. The continuous feeding of paper strip 5 will be described in connection with reference to FIGS. 3–5.

Referring now to FIG. 3, a side-sectional view of hand-held electronic calculator 60 including microprinter 30 constructed and arranged in accordance with the invention is shown. A plate spring 31 is disposed between back cover 2 and paper strip bundle 6 for pushing the top paper strip 5 towards the first paper feed roller 7. Calculator 60 also includes a battery 32 which is accessible when back cover 2 is opened. A circuit board 33 is disposed beneath calculator case 1 on which is mounted an LSI and any additional electronic elements in a circuit chip 34. The remaining elements of calculator 60 are indicated by the same reference numerals as utilized in FIGS. 1 and 2.

Turning now to FIG. 4, microprinter 30 is shown in condition where paper strip bundle 6 is placed within the interior space of the calculator 60. Uppermost paper strip designated as 5 is shown biased against first paper feeding roller 7 due to the load of plate spring 31. Uppermost paper strip 5 is about to be fed out in the direction of arrow G due to the counterclockwise rotation of paper feeding roller 7. The printing operation commences when paper strip 5 passes through print position P, the space between character ring 16 and platen 22. In FIG. 3, the position of paper strip 5 is shown wherein paper strip 5 has been printed on and is being fed out of an opening 1' in calculator case 1.

When paper strip 5 is at print position P it is necessary to be certain that it is stretched out in order to permit clear printing. In order to insure this condition, second paper feeding rollers 11 and 12 disposed after print character ring 16 are rotated faster than first paper feeding roller 7 in order to insure a favorable print condition being maintained in paper strip 5. As shown in FIGS. 3–5, first paper feed roller 7 and second paper feed rollers 11 and 12 substantially are in the same plane as paper strip 5 being fed through print position P.

Referring now to FIG. 5, the condition wherein paper strip 5 is being fed out of calculator 60 and the next paper strip **5*a* begins to be advanced out of bundle 6 after the end of strip 5 is removed from contact by character ring 16 is shown. When first paper strip 5 leaves frictional engagement with first paper feeding roller 7, second paper strip 5*a* is engaged thereby and begins to be advanced. First paper strip 5 continues to be advanced by second paper feeding rollers 11 and 12 until first paper strip 5 is out of engagement therefrom. Thus, paper strips 5 from bundle 6 are continuously supplied as a continuous piece of paper. When printing is completed in the middle of paper strip 5, it may be removed by manually pulling in the direction of arrow BA. When pulling in the direction of arrow BA coupling 10 is taken out of operative engagement with drive gear 8 as the rotational force on shaft 7' overcomes the force of spring 9. After removal of paper strip 5, coupling 10 reengages drive gear 8 and feed roller 7 due to the force of spring 9. In this condition, paper strip 5 is easily removed from calculator 60**.

Referring now to FIG. 6, a paper advancing assembly 40 constructed and arranged in accordance with another embodiment of the invention for use in microprinter 30 is shown. A first paper feeding shaft 41 including rollers 41' and 41'' spaced apart about the width of paper strip 5 is disposed before print character ring 16. A second paper feeding shaft 42 is disposed behind character ring 16 and similarly includes a pair of spaced apart rollers 42' and 42''. Each corresponding pair of rollers 41' and 42' and 41'' and 42'' are linked by belts 44 and 43, respectively. Each belt 43 and 44 engages paper strip 5 on the outer edge thereof and this engagement extends from before to behind the printing position thereby insuring smooth feeding of paper strip 5.

Figure 7:
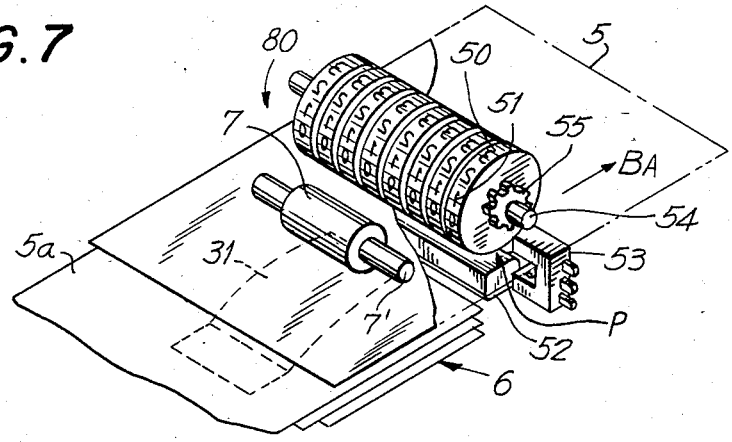
FIG. 7 is a partial perspective view of a microprinter including a sensor in accordance with another embodiment of the invention.

The printing and paper feeding operations have been described above for a serial printer including a single displaceable character ring 16. Of course, the invention is not limited to a printing calculator having a single character ring 16, but is readily applied to a parallel printer having a character drum or a plurality of character rings 50 as shown in FIG. 7, or with a mechanical or thermal dot printer. In these hand-held calculators 60 including the microprinter 30 constructed and arranged in accordance with the invention, paper strips 5 are handled just like a roll of print paper. However, since the mass and inertia of the paper strip 5 is considerably less than that of a paper roll, the load of the paper feeding assembly is substantially reduced and fluctuations in the pitch are extremely small. Accordingly, a microprinter 30 is substantially more compact and paper strip bundle 6 may be readily placed in the paper storage area within the calculator case 1. Thus, miniaturization and ease of loading are readily attained.

Referring now to FIG. 7, a portion of a microprinter 80 constructed and arranged in accordance with a further embodiment of the invention including a paper photosensor 53 disposed at print position P is shown. In this embodiment, microprinter 80 includes a plurality of print character rings 50 each rotatably mounted about a print shaft 54 and each having a plurality of print characters 51 disposed about the periphery. Each print character ring 50 has an associated print gear 55 mounted on the side for positioning an appropriate character 51 in the print position P for the appropriate column. Characters 51 are selected by a selecting electro-magnet (not illustrated) and the selected characters 51 are impacted against a platen 52 for printing the desired characters 51 on the paper strip 5. Following printing, paper strip 5 is advanced in the direction of arrow BA by rotating first paper feeding roller 7 in the manner described above.

First paper feeding roller 7 in this embodiment of the invention is controlled by a signal generated from photosensor 53 disposed at print position P at print character ring shaft 54. Photosensor 53 detects presence of paper strip 5 at the print position P. When paper strip 5 is advanced in direction of arrow BA and no longer passes through to interrupt the light beam in photosensor 53, a signal is generated by the control circuit which advises the user that printing of the calculating results on paper strip 5 has been completed and that the uppermost paper strip **5*a* of bundle 6** is about to be advanced to the print position.

Figure 8:
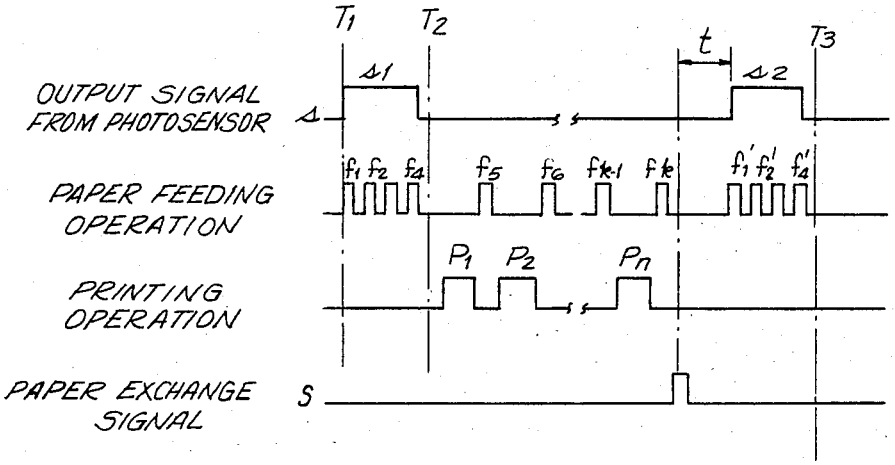
FIG. 8 is a timing chart showing the main operations of the microprinter constructed and arranged in accordance with the invention.

FIG. 8 is a timing chart of the principal operations of microprinters 30 and 80 constructed and arranged in accordance with the invention. When paper bundle 6 is placed in calculator 60, the optical beam of photosensor 53 is not interrupted so that a signal $s_1$ indicating absence of paper strip 5 in the print position P is generated by photosensor 53. Calculator 60 includes a program for turning first paper feeding roller 7 during the period that signal $s_1$ is generated. Paper strip 5 is advanced until the optical beam of photosensor 53 is interrupted and at this time advancement is stopped.

Turning to the timing chart, paper feeding operations $f_1$ to $f_4$ occur during the period output signal $s_1$ is generated. At this time microprinters 30, 80 advance from a nonprinting position $T_1$ to a printing position $T_2$. When microprinters 30, 80 are in the printing position $T_2$, the various printing operations—$P_1$, $P_2 \ldots P_n$—for printing calculating results 61 by impacting the various print character rings 16, 50 against platens 22, 52 are performed. After each print operation, paper feeding—$f_5$, $f_6 \ldots f_{k-1}$ and $f_k$—are performed for advancing paper strip 5.

Clearly the number of paper advancement steps for a single paper strip 5 depends on the length of strip 5 as well as the paper feeding pitch. Thus, it is possible to produce a signal S at the time of change-over from first paper strip 5 to next paper strip **5*a* just before the end of first paper strip 5 is removed from print position P. At this time, microprinters 30, 80 are prevented from printing and generate an outside signal to advise the user that the end of paper strip 5 is approaching print position P. After signal S is produced paper strip 5 is removed from calculator 60, change-over to next paper strip 5*a* occurs during time interval t. After time interval t, a signal $s_2$ indicating the absence of paper at print position P is produced by photosensor 53 and paper feeding operations for advancing uppermost strip 5*a*—$f'_1$ to $f'_4$—occur. As soon as the optical beam is intercepted by next paper strip 5*a*, microprinters 30, 80 are placed in a printing stand-by state at position $T_3$ equivalent to the printing stage of position $T_2$. Thus, after paper strip bundle 6 is placed in calculator 60, microprinters 30, 80 are placed in a printing stand-by state when uppermost paper strip 5 is advanced to print position P and intersects the optical beam of photosensor 53** in accordance with the paper feeding program.

As noted above, hand-held printing calculator 60 including microprinters 30, 80 constructed and arranged in accordance with the invention utilizing paper strips 5 can print continuously in much the same manner as a continuous paper roll. Significantly, paper strips 5 substantially reduce the paper feeding load when compared to the paper roll as the force necessary for advancing paper strip 5 is substantially less than for advancing a paper roll. Moreover, as paper strips 5 may be easily placed within calculator case 1 and do not provide a bulky roll outside the case, a compact calculator 60 worthy of the name "hand-held" is provided It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A hand-held printing calculator for printing calculating results on paper strips stored flat within the calculator comprising:

case means for defining an interior space and including paper storage means for storing a plurality of paper strips;

calculator and printer circuit means within said interior space for performing calculating operations and generating corresponding print signals for printing the calculating results on a paper strip stored in said calculator;

print means in said case means for printing on said paper strips in response to said print signals when one of the paper strips is in a print position adjacent said print means;

paper advance means for continuously advancing a paper strip from the paper storage means to the print position, including first paper feeding means disposed before the print position and second paper feeding means disposed after the print position, said second paper feeding means advancing the paper strip at a faster rate than said first paper feeding means and the first and second paper feeding means disposed substantially in the same plane as the plane of the paper strip being advanced at the print position; and biasing means for biasing said paper strip towards said first paper feeding means.

2. The hand-held printing calculator of claim 1, further including detection means for detecting the presence of the paper strip at the print position, the detection means generating a signal upon the absence of paper at the print position, said signal applied to said paper advance means for advancing one of the paper strips stored in the means for storing a plurality of paper strips to said print position.

3. The hand-held printing calculator of claim 1, wherein said paper storage means is adapted to receive a plurality of paper strips stacked one on top of each other in the form of a bundle for continuous feeding by said paper advance means.

4. The hand-held printing calculator of claim 1, wherein said print means includes at least one print character ring having characters disposed about the periphery thereof and a platen disposed adjacent said character ring with said paper strip between said character ring and platen at the print position, the character ring selectively displaceable towards said platen for printing upon impact of said ring against the platen.

5. The hand-held printing calculator of claim 4, wherein said at least one print character ring is slideably mounted for displacement transverse to a paper strip in said calculator for printing at least two rows of characters on the paper strip.

* * * * *